United States Patent [19]

Eck et al.

[11] Patent Number: 5,001,911

[45] Date of Patent: Mar. 26, 1991

[54] RAM PRESS FOR EXPRESSING LIQUID FROM MATERIALS BEING PRESSED

[75] Inventors: Werner Eck, Herzogenaurach; Friedrich Geiger, Heilbronn, both of Fed. Rep. of Germany

[73] Assignee: Passat-Maschinenbau Gmbtt., Heilbronn, Fed. Rep. of Germany

[21] Appl. No.: 254,582

[22] Filed: Oct. 7, 1988

[30] Foreign Application Priority Data

Oct. 7, 1987 [DE] Fed. Rep. of Germany ..... 8713472

[51] Int. Cl.[5] ..... D06F 47/06

[52] U.S. Cl. ..... 68/242; 100/116; 100/125; 100/211; 100/238

[58] Field of Search ..... 100/211, 116, 238, 122, 100/126, 127, 125; 68/242, 21

[56] References Cited

U.S. PATENT DOCUMENTS

| | | | |
|---|---|---|---|
| Re. 24,257 | 12/1956 | Kahn | 68/242 X |
| 1,738,326 | 12/1929 | Smith | 100/211 |
| 4,452,056 | 6/1984 | Files | 100/211 X |
| 4,574,599 | 3/1986 | Pellerin | 100/211 X |
| 4,676,079 | 6/1987 | Czauderna | 100/211 X |
| 4,753,089 | 6/1988 | Engel | 100/211 X |

FOREIGN PATENT DOCUMENTS

| | | | |
|---|---|---|---|
| 3307229 | 9/1984 | Fed. Rep. of Germany | 68/242 |
| 2602845 | 11/1984 | Fed. Rep. of Germany | 68/242 |
| 3347422 | 7/1985 | Fed. Rep. of Germany | 68/242 |
| 758794 | 1/1934 | France | 100/211 |
| 1369759 | 7/1964 | France | 100/211 |

*Primary Examiner*—Philip R. Coe
*Assistant Examiner*—Stephen F. Gerrity
*Attorney, Agent, or Firm*—Joseph Scafetta, Jr.

[57] ABSTRACT

A ram-type press expresses liquid from material being pressed, particularly from a batch of wet textile materials. A press ram can be moved onto the material being pressed by the action of a pressure cylinder. A cylindrical shell, accommodating the material being pressed, can be closed at its bottom by a perforated thrust plate. The materials to be pressed and the press ram can be introduced one after the other from above into the cylindrical shell. The press ram is connected to an edge of an opening of a pot-shaped elastically yielding cushioning member and includes a union which can be connected to a water main in order to introduce water into the cushioning member. The bottom of this cushioning member forms a membrane which can be pressed against the material from which the liquid is to be expressed.

8 Claims, 2 Drawing Sheets

10
11
12
13
14
15
16
18
27
28
29
31
32
33
34
35
37
9

12
13
27
28
29
36
37
38

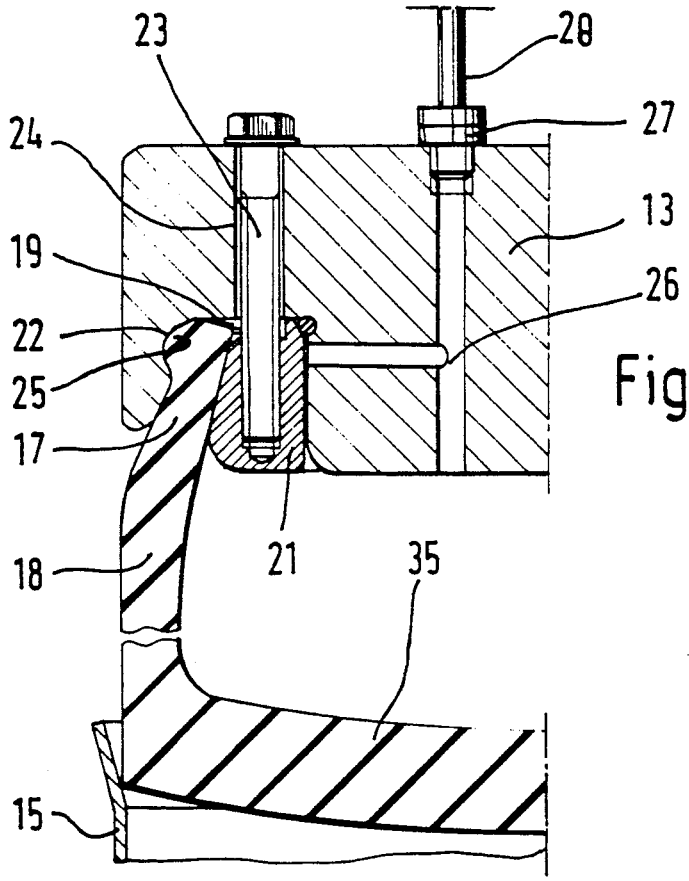
Fig.3
Fig.4
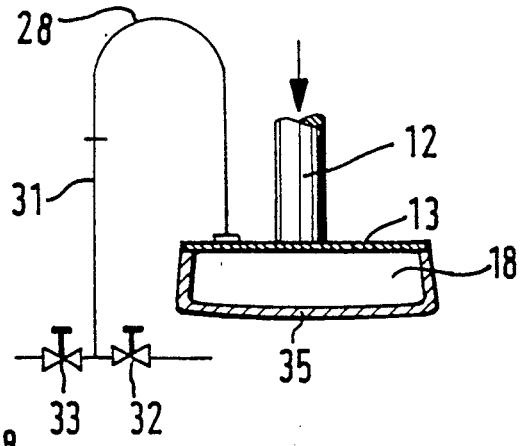
Fig.5
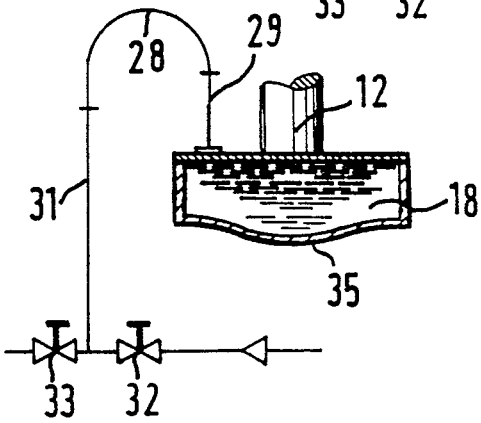

RAM PRESS FOR EXPRESSING LIQUID FROM MATERIALS BEING PRESSED

BACKGROUND OF THE INVENTION

1. Field of the Invention

The invention relates to a ram-type press for expressing liquid from material being pressed, particularly from a batch of wet textile materials.

2. Description of the Related Art

A ram press of this type is described in West German Patent Publication No. 26 02 845.

In the case of the prior art ram presses of this type, a connecting union on the press ram is, while it is stationary, connected by a tube to a water main and introduces water into a cushioning member. Since the water is subjected to a high pressure during pressing, the interior of the cushioning member is completely sealed so that the air present in the cushioning member is unable to escape.

During pressing, the cushioning member is compressed relatively strongly, so that cracks easily occur, particularly at the clamped-in edge of the opening in the cushioning member.

SUMMARY OF THE INVENTION

The invention is based on the problem of so improving the prior art ram-type press that the cushioning member enjoys the longest possible working life.

According to the invention, this problem is resolved in that it provides a pipe which maintains the connecting union constantly linked to the water main and a valve means adapted to be actuated from a place outside the path of movement of the press ram and which can optionally be switched to the supply of water or to the bleeding of air.

The inventor has, in fact, acknowledged that the marked deformation of the cushioning member during pressing is occasioned by the air remaining in the cavity in the pot-shaped cushioning member. When the machine is pressing and applying a high pressure, in fact, the air contained in the cavity in the cushioning member is compressed to a fraction of its volume, which means that also the cushioning member is compressed by a relatively considerable amount. The invention ensures that, by suitably actuating the valve means, it is possible firstly to introduce water into the cushioning member, e.g. at the pressure of the water main. Then the valve means is switched so that the cavity in the cushioning member is connected to the outside ambient atmosphere, thus allowing any air still present in the cushioning member to escape.

Then the cushioning member, together with the press ram, is pressed against the thrust plate sufficiently long for water to emerge from the valve means, so indicating that there is no longer any air present in the cushioning member. Then the valve means is switched back to the water feed and the cushioning member is filled with water until the membrane is downwardly convex.

Since water is for practical purposes incompressible, and since during pressing the cylindrical shell surrounds the cushioning member, its side walls are subjected to only negligible deformation during pressing.

In order to achieve a reliable gripping of the cushioning member in the press ram even with these deformations of the cushioning member which are unavoidable within the invention, by an advantageous embodiment of the invention, it is provided that in its bottom face, which is facing towards the pressure plate, the press ram has, for engagement of the edge of the opening of the pot-shaped cushioning member and of a clamping ring, an annular groove which in its radially outer wall is provided with an encircling depression beside the groove bottom. There is, on the outer edge of the opening in the pot-shaped cushioning member, an encircling bead intended to engage the encircling depression. Also, there are in the press ram through-bores for screws by means of which the clamping ring can be drawn into the groove on the inside of the opening rim. During pressing, the opening edge or rim is subjected to deformation immediately beside the clamping location and outside of the clamping gap. The construction according to the invention ensures that this deformation occurs at a place at which the opening edge is of constant thickness, so largely avoiding the formation of cracks at this point.

It is particularly advantageous to envisage the radially outer wall of the annular groove and the outer face of the clamping ring which is facing towards it as having upwardly tapering frustoconical surfaces. Consequently, the edge of the opening in the cushioning member acquires a conically downwardly widening shape which, under high pressure, promotes an outward deformation of the cushioning member and thus the smallest possible bending loadings on the edge of the opening at the clamping point.

An advantageous further development of the ram press mentioned at the outset is provided by the peripheral face of the cushioning member. This ensures that, in conjunction with the pot-shaped cushioning member, the feed motion of the press ram occurs with comparatively low friction of the cushioning member against the shell and during processing, that the outer periphery of the membrane is so widened out that a satisfactory seal of the space in the shell which is disposed beneath the membrane is achieved in respect of whatever is above it.

The connecting member, which is longer than the distance between an upper face of the press ram and the underside of the press head in a lower position of the latter, constitutes a further advantageous development of the ram press. In this case, the connecting member may be a chain, a cable, a rod or the like. If the ends of this connecting member, in the upper position of the press ram, are connected to the latter and to the press head, then upon downward movement of the press ram, the enlargement of the distance between the press ram and the press head which results will cause the press ram to be rotated about its axis by the connecting member. It is, however, also possible for the connecting member, as a bend-resistant rod, to have only its upper end articulatingly suspended from the press head, its lower end being left to rest with frictional engagement on the press ram. As the lowered press ram is raised, it is rotated by the pressure of the connecting member which acts obliquely on it.

This feature of the invention has the advantage that, by using the connecting member at regular intervals, e.g. at the beginning of each week, the press ram is rotated about its axis by a specific angle at equal intervals in time. The inventor has indeed recognized the fact that, in the case of one combination of a specific washing machine and a press, the cushioning member always tears at the same place. This can be attributed to the fact that the wash passed from the washing machine into the press always has substantially the same irregularity of surface, so that the cushioning member is always subjected to a more intense loading at the same places.

The invention ensures now that these more heavily stressed places are being constantly changed at regular intervals of time.

Further advantageous features of the invention are described in detail in the ensuing description of an example of an embodiment which is shown in the accompanying drawings.

BRIEF DESCRIPTION OF THE DRAWINGS

FIG. 3 is an enlarged sectional view through the edge of the press ram with the cushioning member clamped to it;

FIG. 4 is a diagrammatic side view of the press ram with the empty cushioning member shown in section; and FIG. 5 is a diagrammatic side view of the cushioning member corresponding to FIG. 4 but completely filled with water.

DESCRIPTION OF THE PREFERRED EMBODIMENT

As an example of the preferred embodiment, a ram press for expressing water from a batch of wet textile materials washed in a washing machine mounted on the upstream side of the press is described hereinafter.

Figure 1:
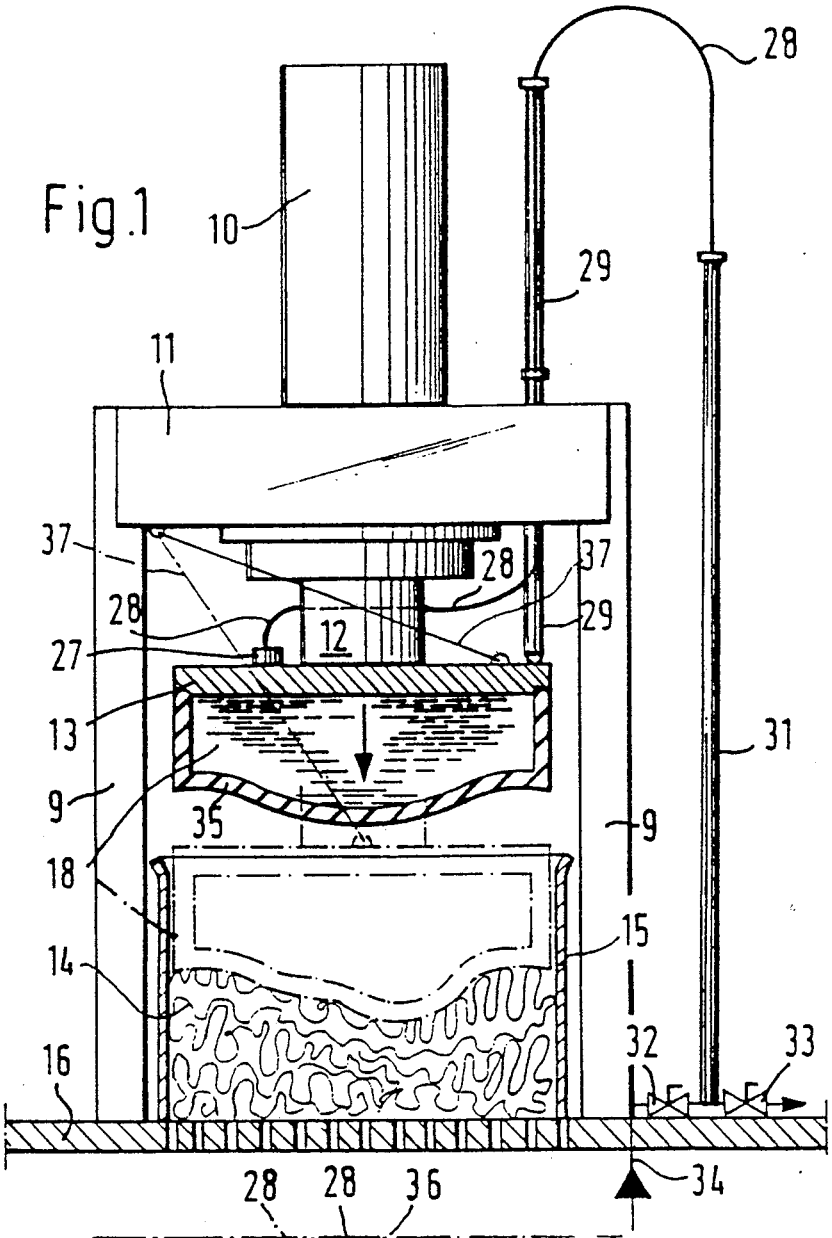
FIG. 1 is a diagrammatic side view of the ram press in its entirety.

The ram press shown in FIG. 1 of the drawings comprises a pressure cylinder 10 being mounted on a press head 11 and having a press ram 13 mounted on a piston rod 12 projecting from under the press head 11. The press head 11 is rigidly connected to a machine frame 9.

The peripheral surface of the press ram 13 is cylindrical. To accommodate the batch 14 of wet textile materials being washed from which the liquid is to be expressed, a cylindrical shell 15 is provided. The inside diameter of the shell 15 is slightly greater than the outside diameter of the press ram 13. The cylindrical shell 15 is closed at the bottom by a perforated thrust plate 16 which is rigidly connected to the machine frame 9. The cylindrical shell 15 is connected to a hoisting apparatus, not shown in the drawings, so that it can be raised and lowered and, in its very lowest position and together with the thrust plate 16, it forms a container for the batch 14 of wet textile materials.

As is shown particularly in FIG. 3, the press ram 13 is on its underside connected to an edge 17 of an opening in a pot-shaped cushioning member 18 which is made of a resiliently yielding material, e.g. rubber, synthetic plastics, or the like.

To connect the edge 17 of the opening in the cushioning member 18 to the press ram 13, this latter element has on its underside an encircling annular groove 19 intended for engagement of the opening edge 17 of a clamping ring 21. Immediately alongside the bottom of the groove 19, an encircling depression 22 is provided in the radially outer wall of the annular groove 19.

In its upper end face, the clamping ring 21 has screwthreaded bores for screws 23 which engage through bores 24 in the press ram 13 and which are intended to engage the screwthreaded bores (unnumbered) in the clamping ring 21.

The radially outer wall of the annular groove 19 and, facing it, the outer surface of the clamping ring 21 are frustoconical surfaces which taper upwardly to substantially the same degree. The opening edge 17 of the cushioning member 18 has on its outer part an encircling bead 25 which fits into the encircling depression 22 inside the annular groove 19.

In order to connect the cushioning member 18 to the press ram 13, firstly the clamping ring 21 is so inserted into the annular groove 19 that the threaded bores in the clamping ring 21 coincide with the bores 24 in the press ram 13. Then the screws 23 are screwed somewhat into the threaded bores in the clamping ring 21 so that this latter element still partly protrudes from the annular groove 19. Into the consequently enlarged intermediate space between the clamping ring 21 and the outer wall of the annular groove 19, the opening edge 17 of the cushioning member 18 is so inserted that the encircling head 25 engages the depression 22. Then the screws 23 are threaded farther into the clamping ring 21 so that this latter element is pressed rigidly against the opening edge 17 of the cushioning member 18.

A bore 26 connects the underside of the press ram 13 and thus the cavity in the cushioning member 18 to a connecting union 27 for a flexible hose 28.

As shown in FIG. 1, a guide tube 29 for the flexible hose 28 is guided for displacement through the press head 11, its weight resting on the top of the press ram 13. The bottom end of the flexible hose 28 projects from a slot in a side of the guide tube 29 while its end which projects upwardly and outwardly from the guide tube 29 is connected to the top end of a vertically disposed pipe 31, the bottom end of which is connected to the first ends of two hand valves 32 and 33. The second end of the hand valve 32 is connected to the public water main via a pipe 34. The second end of the hand valve 33 leads into the open air.

As can be seen particularly in FIG. 1, the cushioning member 18 is pot-shaped. Its bottom, when the cushioning member 18 is empty, forms a flat or, as shown in FIG. 3, a slightly convexly curved membrane 35 which fits snugly against the batch 14 of textile material which is to be pressed. The member 18 also has an outside diameter which is somewhat greater than the inside diameter of the cylindrical shell 15. Since the outside diameter of the press ram 13 is smaller than the inside diameter of the shell 15, the peripheral face of the cushioning member 18, when it is empty, has a frustoconically downwardly widening-out shape, as best shown in FIG. 4.

To achieve an operating condition shown in FIG. 4, firstly the one hand valve 32 is opened while the other hand valve 33 is still closed so that the cushioning member 18 is partly filled with water. When the one hand valve 32 is closed, the other hand valve 33 is opened and the press ram 13 is slowly lowered onto the thrust plate 16 (FIG. 1) or onto a batch 14 (FIG. 1) of wet textile materials disposed thereon, for a sufficient length of time that water emerges through the hand valve 33. When the hand valve 33 has been closed, the press ram 13 is raised, after which the hand valve 32 is opened so that the cushioning member 18 can be filled with water, until the membrane 35 as shown in FIG. 5 is so intensely concavely curved that the outside diameter of the membrane 35 corresponds substantially to the inside diameter of the cylindrical shell 15 (FIG. 1).

Figure 2:
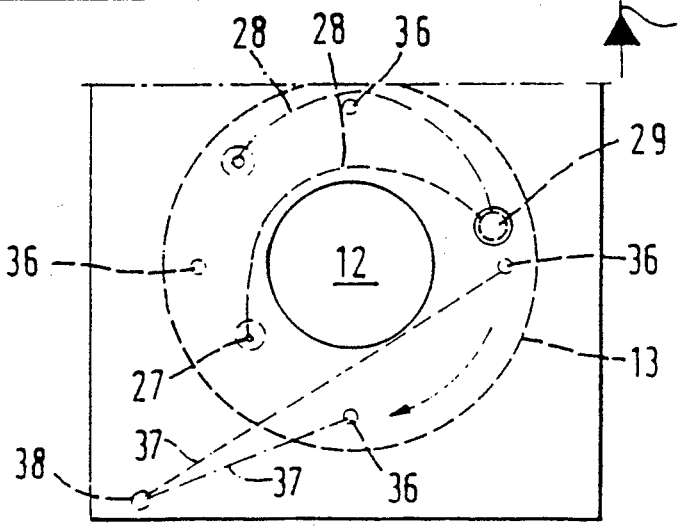
FIG. 2 is a diagrammatic plan view of the ram press in FIG. 1.

As can be seen in FIG. 2, there are on the top of the press ram 13 four threaded bores 36 which are regularly distributed over and are close to the periphery of the press ram 13. These bores 36 receive connecting screws which are not shown in detail in the drawings, and which are mounted at one end of a connecting member 37, the other end of which carries an identical connecting screw which is intended for engagement into a threaded bore 38 in the underside of the press head 11 (FIG. 1).

In the example of the embodiment shown, a chain or a cable is provided as the connecting member 37. However, it is also possible to provide as the connecting member 37 a rod at both ends of which the connecting screws are articulatingly attached. The length of the connecting member 37 is such that it is greater than the greatest distance between the underside of the press head 11 and the top of the press ram 13 so that, upon a complete stroke of the press ram 13 in a downward direction, this latter element is rotated by the connecting member 37 through 90° in the direction of the dashed arrow shown in FIG. 2.

However, it is also possible to provide as a connecting member 37 a bend-resistant rod which carries at its bottom end a friction member, e.g. a rubber foot, while its upper end, when the press ram 13 is in a low position, is articulatingly suspended from the underside of the press head 11 (FIG. 1). As it is raised, the press ram 13 is rotated by the friction member of the connecting member 37 acting upon it.

This connecting member 37 is only occasionally used at identical intervals of time, so that the cushioning member 18 is always rotated into a different angular position at identical intervals of time. After one total rotation of about 270°, the connecting member 37 is disposed on the press ram 13 on that side of the piston rod 12 which is opposite the view in FIG. 2, so that this element is then rotated in the opposite direction and the flexible hose 28 is not wound completely around the piston rod 12.

After the membrane 35 has assumed the position shown in FIG. 1, due to the cushioning member 18 being filled, and once the batch 14 of wet washing textile materials or linens has been placed on the thrust plate 16 inside the cylindrical shell 15, the press ram 13 is introduced into the cylindrical shell 15 by the pressure cylinder 10. Since, when this happens as shown in dashed lines, the cushioning member 18 only touches the inside surface of the shell 15 with the outer periphery of the membrane 35 which substantially corresponds to the inside diameter of the shell 15, the friction between the cushioning member 18 and the shell 15 is very small during this feed movement of the press ram 13.

If then the cushioning member 18 is pressed onto the batch 14 of wet washing textile materials, the convex curvature of the membrane 35 is reduced so that its outer periphery is pressed against the inside wall of the shell 15 to achieve a desirably satisfactory seal during the now only minimal pressing motion of the press ram 13. During this pressing process at high pressure, the water is forced out of the cylindrical shell 15 through the holes in the thrust plate 16. Since the cushioning member 18 is filled with water and no air is enclosed in it and since during pressing, by virtue of the shell 15 surrounding it, the cushioning member 18 is unable for practical purposes to expand in a radial direction, its periphery during pressing is not kinked but is substantially only compressed, thus avoiding the formation of cracks in the cushioning member 18. Then, by means of the lifting apparatus not shown, the shell 15 and the press ram 13 are moved upwardly so that the batch 14 of wet washing textile materials from which the liquid has been expressed can be removed from the upper surface of the thrust plate 16.

In order to disperse excess water which may be present in the batch 14 of wet washing textile materials, there are bores in the cylindrical shell 15 which are not shown in the drawings. After repeated pressing, e.g. within a week, then, while the press ram 13 is raised, the connecting member 27 is attached to the press ram 13 and the press head 11. An ideal stroke is then performed in order thereby to rotate the press ram through 90°. Once this rotation has been carried out three times, preferably after identical periods of time, for the next time, the connecting member 37 is connected to the press ram 13 on the other side of the piston 12 so that the piston rod 12 can be turned back through the 270°.

The angle of rotation through which the press ram 13 is rotated by means of the connecting member 37 is not critical and can be adapted to the relevant circumstances. The rotation can therefore be carried out by, in each case, 30° or 45° or so on. The change of the side of the piston rod 12 on which the connecting member 37 is disposed is only required after more than three rotations comprising at least 270°.

As shown in FIG. 3, a transition between an outer face of the clamping ring 21 and a lower face of the clamping ring 21 is rounded off and has a radius of curvature which is at least half as great as a thickness of the opening edge 17 of the cushioning member 18 below the encircling bead 25.

The foregoing description and the following drawings are confined only to the features which are in combination essential to the invention. Therefore, in so far as features are disclosed in the description and also in the drawings but are not mentioned in the claims, they are conducive to defining the object of the invention.

What we claim as our invention is:

1. A ram press for expressing liquid from material which is to be pressed, particularly from a batch of wet textile materials comprising:

a pressure cylinder having a piston rod;

a press ram having a path of movement and being adapted to be moved by the piston rod of the pressure cylinder onto the material which is to be pressed;

a cylindrical shell having a bottom and accommodating the material which is to be pressed, said shell allowing introduction from above of the material which is to be pressed first and then of the press ram;

a perforated thrust plate means for closing the bottom of the cylindrical shell;

a pot-shaped elastically resilient cushioning member having an opening edge connected to the press ram and also having a bottom which forms a membrane that can be pressed against the material from which liquid is to be expressed;

a union means, connected to the press ram, for introducing a supply of water into the cushioning member;

a pipe means for connecting the union means constantly to the supply of water;

valve means, connected to the pipe means and actuated from a location outside the path of movement of the press ram, for introducing the supply of water into the cushioning member;

a press head arranged on the pressure cylinder above the piston rod thereof, said press head having an underside; and a connecting member which is longer than a distance between an upper face of the press ram and the underside of the press head in a lower position of the latter, said connecting member having a bore means, provided on the underside of the press head, for securing the connecting member thereto so that, by moving the press ram along the path of movement, the connecting member turns the press ram about the path of movement.

2. A ram press for expressing water from a batch of wet textiles, comprising:

a press ram being adapted to be moved back and forth along a path of movement onto the batch of wet textiles;

a drive means for moving the press ram;

a cylindrical shell having an upper opening, a bottom opening, and an inside diameter;

a perforated thrust plate means for closing the bottom opening of the cylindrical shell to form a receptacle means for receiving the batch of wet textiles;

a pot-shaped flexible cushioning member which includes a chamber means for receiving water, said cushioning member having a bottom and an opening located opposite to the bottom, said opening being surrounded by an edge means for connecting the cushioning member to the press ram so that the press ram closes the opening of the cushioning member and the bottom forms a membrane means for pressing the batch of wet textiles when the press ram is moved through the upper opening of the cylindrical shell onto the batch of wet textiles, said edge means having a radially inner surface and a radially outer surface;

said press ram having a bottom face which is facing towards the thrust plate means;

an annular groove means, formed in the bottom face of the press ram, for receiving the edge means of the cushioning member, said annular groove means having a radially outer wall;

a ring means for clamping the edge means of the cushioning member within the annular groove means, said ring means having a radially outer face and a lower face;

a depression means, formed in the radially outer wall of the annular groove means, for encircling the annular groove means; and an encircling bead means, formed on the radially outer surface of the edge means of the cushioning member, for engaging the depression means when the edge means engage the annular groove means.

3. The ram press according to claim 2, further comprising:

bore means, located in the press ram, for retaining fasteners so that the ring means can be pulled into the annular groove means and can abut the edge means of the cushioning member when the edge means engages the annular groove means.

4. The ram press according to claim 3, wherein the radially outer wall of the annular groove means and the radially outer face of the ring means are upwardly tapering frustoconical surfaces for abutting the radially outer surface and the radially inner surface of the edge means, respectively, when both the edge means and the ring means are in engagement with the annular groove means.

5. The ram press according to claim 4, wherein the edge means of the cushioning member has a thickness below the encircling bead means and includes a rounded-off transition between the radially outer face and the lower face of the ring means, said transition having a radius of curvature which is at least half as great as the thickness of the edge means.

6. The ram press according to claim 2, wherein the radially outer wall of the annular groove means and the radially outer face of the ring means are upwardly tapering frustoconical surfaces for abutting the radially outer surface and the radially inner surface of the edge means, respectively, when both the edge means and the ring means are in engagement with the annular groove means.

7. The ram press according to claim 6, wherein the edge means of the cushioning member has a thickness below the encircling bead means and includes a rounded-off transition between the radially outer face and the lower face of the ring means, said transition having a radius of curvature which is at least half as great as the thickness of the edge means.

8. A ram press for expressing water from a batch of wet textiles, comprising:

a machine frame;

a ram means, adapted to be reciprocated along a path of movement within the machine frame from an uppermost position to a lowermost position, for pressing onto the batch of wet textiles;

a drive means for moving the ram means within the machine frame;

a cylindrical shell having an upper opening, a bottom opening, and an inside diameter;

a perforated thrust plate means for closing the bottom opening of the cylindrical shell to form a receptacle means for receiving the batch of wet textiles;

a means, rigidly connected to the machine frame above the ram means, for supporting and guiding the ram means along the path of movement and for rotating the ram means about a vertical axis which is coaxial with the path of movement;

said supporting and guiding means and said ram means each having an underside and an upper side, respectively, which are facing each other;

said underside of the supporting and guiding means and said upperside of the ram means having a greatest distance from each other when the ram means is in the lowermost position; and a longitudinal connecting means having one end for separable connection to the underside of the supporting and guiding means, another end for separable connection to the upperside of the ram means, and a length which is greater than said greatest distance so that, by moving the ram means along the path of movement, said connecting means turns the ram means about the vertical axis which is coaxial with the path of movement.

* * * * *